US007556241B2

(12) United States Patent
Geagan

(10) Patent No.: US 7,556,241 B2
(45) Date of Patent: Jul. 7, 2009

(54) POWER-ASSISTED WINCH AND METHOD

(76) Inventor: Michael J. Geagan, 15 Forest Rd., Wayne, PA (US) 19087

( * ) Notice: Subject to any disclaimer, the term of this patent is extended or adjusted under 35 U.S.C. 154(b) by 299 days.

(21) Appl. No.: 11/511,791

(22) Filed: Aug. 28, 2006

(65) Prior Publication Data

US 2008/0078979 A1 Apr. 3, 2008

(51) Int. Cl.
*B66D 1/14* (2006.01)

(52) U.S. Cl. ..... 254/342; 254/345; 254/346; 254/362

(58) Field of Classification Search ..... 254/342, 254/345, 346, 362
See application file for complete search history.

(56) References Cited

U.S. PATENT DOCUMENTS

| | | | | |
|---|---|---|---|---|
| 3,126,166 | A * | 3/1964 | Weinberg | 242/250 |
| 4,088,304 | A | 5/1978 | Gradert | 254/184 |
| RE30,423 | E | 10/1980 | Hutton et al. | 254/346 |
| 4,921,219 | A | 5/1990 | Ottemann et al. | 254/284 |
| 4,924,795 | A | 5/1990 | Ottemann | 114/107 |
| 4,962,901 | A * | 10/1990 | Shirley et al. | 242/323 |
| 5,176,364 | A | 1/1993 | Bell | 254/291 |
| 5,368,279 | A | 11/1994 | Ottemann et al. | 254/342 |
| 5,842,684 | A | 12/1998 | Aho | 254/344 |
| 5,863,028 | A | 1/1999 | Dunsmore | 254/343 |
| 5,915,673 | A * | 6/1999 | Kazerooni | 254/270 |
| 6,036,174 | A | 3/2000 | Andersen | 254/343 |
| 6,250,607 | B1 * | 6/2001 | Strom | 254/362 |
| 6,431,103 | B1 | 8/2002 | Meyerdicks | 114/218 |
| 6,776,397 | B2 | 8/2004 | Vado et al. | 254/342 |
| 7,090,200 | B2 * | 8/2006 | Morse et al. | 254/332 |

FOREIGN PATENT DOCUMENTS

| | | |
|---|---|---|
| EP | 0 676 365 B1 | 12/1994 |
| GB | 2 013 375 A | 2/1979 |
| WO | WO 96/09980 | 4/1996 |
| WO | WO02/24567 A1 | 3/2002 |

* cited by examiner

*Primary Examiner*—Emmanuel M Marcelo

(57) ABSTRACT

A power assisted winch and method include a control system and method for detecting the amount of turning force or torque supplied by a manual input drive to the winch drum, supplying turning force or torque from a motor to the winch drum and controlling the amount of torque supplied by the motor to the winch drum as a function of the amount of turning force or torque supplied by the manual drive. The function may be a fixed predetermined ratio or it may vary depending upon the level of turning force or torque supplied by the manual input drive. A torque sensor may be utilized to detect the level of input manual torque and control apparatus controls the amount of torque supplied by the motor to gearing or coupling driving the winch drum.

21 Claims, 1 Drawing Sheet

POWER-ASSISTED WINCH AND METHOD

FIELD OF THE INVENTION

The present invention relates to a power assisted winch and method. More particularly, the present invention relates to a winch which may include a manual drive and power assistance to the manual drive in some ratio to the manual drive input which will allow the user to maintain some "feel" of the force being applied to the line being controlled by the winch drum.

BACKGROUND OF THE INVENTION

Winches find widespread use in various applications. One important and widespread area of use of winches today is for pulling in lines attached to sails and anchors on sailboats and other boats. However, winches find various other applications including use on recreational vehicles and in industrial applications.

In the past, winches were known to be operated manually by a winch handle or crank which drove the winch usually through gearing. More recently, applications of motors have been utilized to drive winches, such as electric motors. However, these suffer from various deficiencies including the fact that the winch is either full on or full off. In other words, by pressing a button or actuating a switch, the winch is on and would operate at full speed. By releasing the button or deactivating a switch, the winch would be turned completely off.

Recently, there has been a disclosure of a winch in which the speed of the winch could be varied by utilizing a direct current electric motor operated or controlled by a pulse width modulator and potentiometer. For example, see WO 02/24567 A1 which discloses a variable-speed drive assembly for a winch for a water vessel such as a yacht which includes an electric motor controlled by a pulse-width modulator and potentiometer.

However, none of the prior art provides a means wherein a winch may be manually operated with power assistance, thereby providing the operator with a "feel" of the force being applied to the line and the conditions of the line, sail, anchor or other load on the line.

SUMMARY OF THE INVENTION

One advantage of the present invention is that it provides a winch which may be manually operated, but with power assistance. The winch of the present invention may also be operated purely manually or solely by motor drive.

An advantage of the present invention is that it provides the operator with a "feel" of the amount of load on the line and the amount of force being applied to the line without the operator supplying the full force manually.

Briefly and basically, in accordance with the present invention, a winch includes a winch drum and a manual input drive for applying a turning force or torque to the winch drum. A motor for supplying a turning force or torque to the winch drum is also provided. A controller for selectively controlling the amount of turning force or torque supplied by the motor to the winch drum is provided to provide assistance to the manual input.

In a presently preferred embodiment, a sensor senses at least the amount of manually supplied input torque and provides a control signal to the motor for supplying torque as a function of the manual input torque. This function of the input turning force or torque may be a fixed ratio of the input torque or the amount of torque supplied by the motor may vary as a function of the amount of input torque. In other words, for low torque manual input, the amount of torque supplied by the motor may be a smaller ratio than when a large manual input torque is applied.

However, it is understood that the input turning force or torque could be determined by measuring the motor torque and total output torque, taking the difference as the input torque. In other words, input+motor=total output. By measuring any two of these turning forces or torques, the third can be computed.

The present invention includes both the winch apparatus and the method of supplying the combination of manual and motor torque to the gearing for driving the winch drum.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

Figure 1:
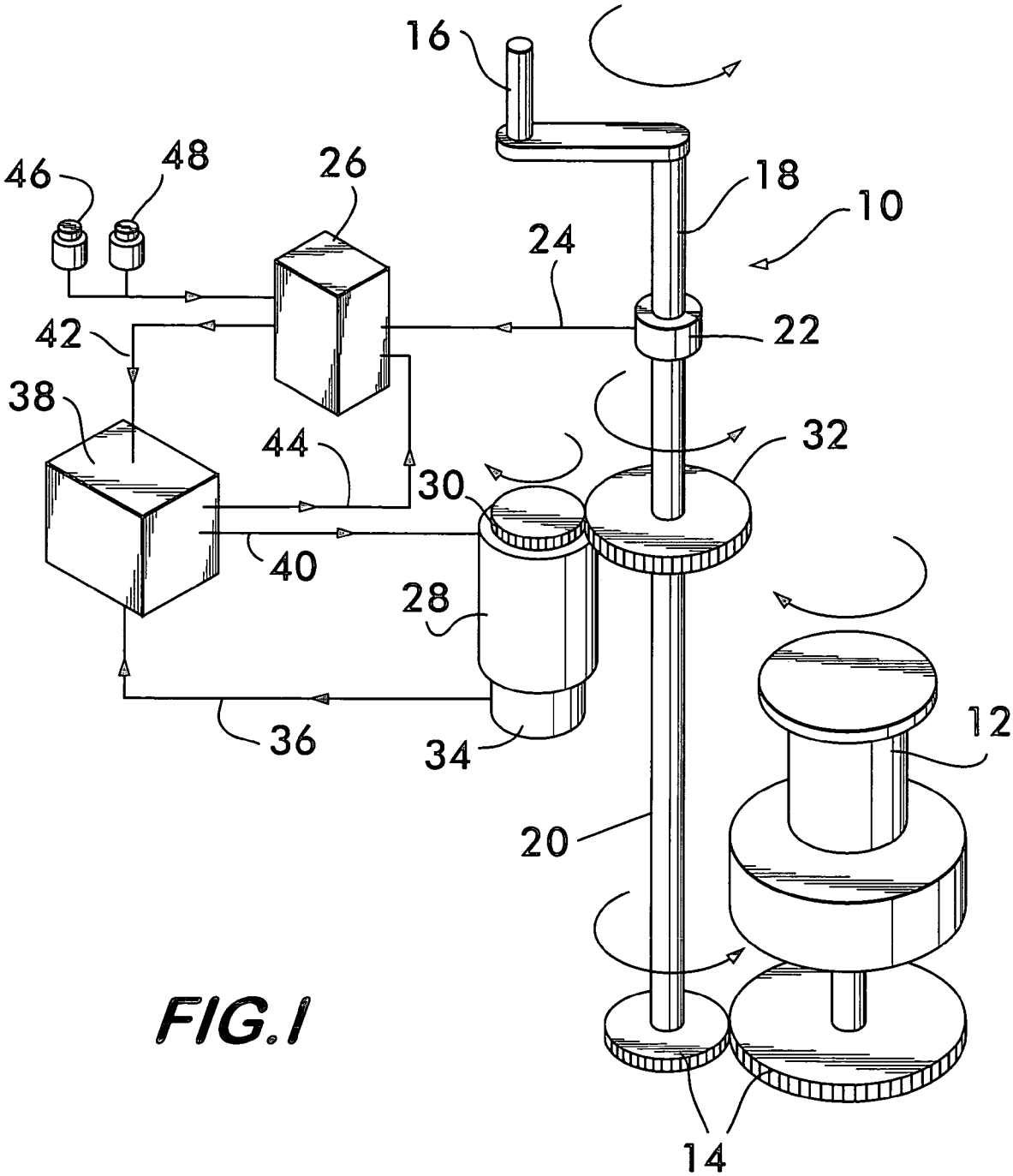
FIG. 1 is a schematic diagram of a power assisted winch in accordance with the present invention.

It is emphasized that FIG. 1 is a schematic diagram of the present invention. The input crank handle may be concentric with the winch drum, and often is. However, in other embodiments, the manual input drive may be separate from the winch drum. Further, the input and output shafts may be parallel and separated as shown, or at right angles to one another, or coaxially located, or in another configuration.

DETAILED DESCRIPTION OF THE PREFERRED EMBODIMENTS

Referring now to the drawings, wherein like numerals indicate like elements, there is shown in FIG. 1 a schematic diagram of a power-assisted winch in accordance with the present invention. As described above, the winch of the present invention may preferably be utilized on sailboats to haul in sails and haul up anchors or the like, but finds application in many other areas.

Referring to FIG. 1, there is shown a schematic diagram of a winch 10 in accordance with the present invention. Winch 10 includes a winch drum 12 driven by gearing or other coupling 14. A winch handle or crank 16 provides a manual input drive for applying torque to the gearing or other coupling 14. Although gearing is a presently preferred embodiment, it is understood that the inputs to the winch drum may be coupled in other manners. For example, it is possible to directly couple the input shaft to the drum, and this may be done for small winches or it may be possible to use other means of coupling such as cogged belts and the like. Manual input drive 16 supplies a turning force or torque via upper shaft 18 and lower shaft 20. Upper shaft 18 and lower shalt 20 are coupled together by torque sensor 22.

Input torque sensor 22 measures the force applied by the user to input shaft 18 via winch handle 16. Torque sensor 22 may comprise an inner hub and an outer hub separated by four button load cells, such a model S400 made by Strain Measurement Devices, 130 Research Parkway, Meriden, Conn. 06450. The inner hub may be coupled to the upper shaft 18 and the outer hub may be coupled to the lower shaft 20. The load cells may be positioned between the hubs in such a way that clockwise rotation of the upper input shaft applies compression force to two of the load cells. Counterclockwise rotation applies compression force to the two other load cells. The signals from the load cells may be carried from the rotating torque sensor by slip ring couplings, such as those made by Moog, Inc., Jamison Road, East Aurora, N.Y. 14052. The output of the manual input drive torque sensor 22 is supplied via line 24 to winch controller 26.

Although in a presently preferred embodiment, an input torque sensor 22 may be utilized, it is understood that other means of measuring the torque or turning force may be provided. For example, a load cell may be located in the arm of crank 16 which senses the turning or bending force applied to the input handle. The force on the input handle multiplied by the handle length provides a measure of the torque. In this manner, the torque may be determined by measuring the bending force applied to the handle multiplied by the handle length. Alternatively, the input turning force or torque may be determined from measurement of the motor force and the total output force provided by the drum. Total output force applied to the drum may be measured by measuring the strain on sensors located in mountings between the base of the drum assembly and the yacht or other mounting structure.

Additional turning force or torque is supplied to gearing or coupling 14 and lower shaft 20 via servo motor 28. Servo motor 28 supplies turning force or torque via gearing or coupling 30 and 32 to lower shaft 20, gearing or coupling 14 and winch drum 12. Servo motor 28 is provided with an encoder 34 which supplies motor, speed and direction signals via line 36 to servo motor controller 38. Motor drive power is supplied via line 40 by servo motor controller 38 to servo motor 28.

Servo motor 28 may preferably be a brushless AC motor with a built-in Hall-effect encoder 34. The motor may be a three-phase synchronous permanent magnet motor with its speed being controlled by the frequency of the its sinusoidal input power. The torque of servo motor 28 is determined by the current applied to it. One motor that meets these requirements and may be used in the system is the SVM-220 sold by Automation Direct, 3505 Hutchinson Road, Cumming, Ga. 30040.

Servo motor controller 38 may convert 12 or 24 volt DC power from a boat's batteries into three-phase AC power to drive servo motor 28. This is particularly the case where the winch is not used with AC power readily available. Servo motor controller 38 receives digital torque and direction commands from a microprocessor in winch controller 26 via line 42. This input from winch controller 26 via line 42 causes servo motor 28 to run at the commanded turning force or torque level. Servo motor controller 38 also measures the motor speed and reports the speed via line 44 in the form of a digital signal to a microprocessor in winch controller 26.

Winch controller 26 includes a microprocessor based logic circuit which has several functions, including maintaining a predetermined relationship between the input turning force or torque and motor turning force or torque by sending turning force or torque commands to servo motor controller 38. It also filters variations in the output turning force or torque command using the winch speed and turning force or torque reported by the servo motor controller in order to provide smooth response to changes in user's input force.

Winch controller 26 may be a self programmable logic controller (PLC) such as the DirectLogic 05 sold by Automation Direct, 3505 Hutchinson Road, Cumming Ga. 30040. The winch controller algorithm may be stored in a non-volatile ROM (read-only memory) on the winch controller.

The winch 10 may be operated in three different operating modes, including (1) complete manual operation; (2) power-assisted operation and (3) full-power operation.

During manual operation, the operator applies a turning force to the winch handle 16 and this force is transmitted through upper shaft 18 and lower shaft 20 and gearing or coupling 14 to winch drum 12. The motor is electrically disconnected from the motor controller so that no power assistance is applied. This is an optional feature of the present invention.

During power assisted operation, force from the motor is added to the force applied by the user. This force may be applied in a ratio which is a function of the input force. This may be referred to as a target ratio. The target ratio may be fixed or predetermined or it may vary depending upon the input conditions, such as the amount of input force. For example, the ratio of input force to output force may be fixed. That is, the motor could always apply five times or some other predetermined amount of the input force, or it may be variable. For example, the ratio could be low at low manual input force and high at higher manual input force. This would provide better "feel" at low loads, while maintaining the ability to apply high amounts of force when the load is high. The power assistance in the ratio is controlled by winch controller 26. Winch controller 26 may be programmed to provide a fixed ratio or a ratio on a predetermined function of input force.

When an input turning force is applied manually to the winch handle 16, winch controller 26 monitors the input torque ieported by input torque sensor 22 and the motor output torque reported by servo motor controller 38. Winch controller 26 computes the ratio of the input and torque measurements. This is the measured ratio. The winch controller 26 then compares the measured ratio to the target ratio. When the target ratio is higher than the measured ratio, not enough power assistance is being applied, so winch controller 26 commands the servo motor controller 38 to increase the motor torque. Conversely if the measured ratio is higher than the target ratio, too much power is being applied and the winch controller commands the servo motor controller 28 to reduce the motor torque. The manual and motor forces are combined and drive the winch drum through gearing or coupling 14. If the load on the winch increases, the winch will stop unless additional force is applied to the winch handle. This behavior mimics that of a conventional manual winch and provides the "feel" of the load on the line being worked by winch drum 12.

During full power operation, only the motor applies force to the winch. The winch handle 16 may be removed and no manual power is applied. The user initiates operation by actuating a switch or button located near the winch such as switch buttons 46 and 48. Winch controller 26 commands servo motor controller 38 to smoothly accelerate the motor to a predetermined speed. When the user releases the button switch 46 or 48, the winch controller commands the servo motor to stop the motor. Two switches are provided, one operates the input of the winch in one direction for high speed and low torque and one operates the input of the winch in the other direction for low speed and high torque. This change of speed and power is set by the winch gearing or coupling. The winch drum always turns in the same direction and the industry standard is conventionally clockwise. Usually, the gear or coupling ratio depends upon the direction of rotation of the input crank for a manual winch.

It is understood that other types of motors such as brush DC motors may be used which are controlled by varying the input current. This may be done by using pulse width modulation in which the line voltage is switched off and on very rapidly in order to modulate the amount of current sent to the motor. The longer each pulse lasts, the more current flows to the motor and hence the more power it will produce. It is possible to use a DC brush motor in this application, but it is currently preferred that an AC motor be used as it is believed that it offers better control for rapid changes in direction and force.

The components of the winch may be housed inside winch drum 12 in a sealed casing below the mounting surface.

In accordance with the present invention, the power assistance may work in both the clockwise and counterclockwise directions, enabling the winch to operate at two different direction-dependent speeds set by the gearing or coupling. The motor may be electric or hydraulic. The winch handle and the motor may be in series or in parallel. Although described in electrical context, the torque sensors and winch controller may be mechanical, electrical, hydraulic or a combination of all three.

Because of the torque multiplication, a shorter winch handle may be used, reducing arm and shoulder motion required. Typical winch handles are 8 to 10 inches long and a 4 to 6 inch handle may be utilized in the present invention in power assist mode. Further, the torque sensors need not measure the torque directly. For example, the output torque of the motor may be computed based upon the input power and speed. The output torque of the motor can also be measured indirectly by subtracting the input torque from output torque of the entire winch.

In accordance with the method of the present invention, a winch may be driven by providing a manual input drive and a motor input drive wherein the amount of assistance by the motor is varied as a function of the amount of input torque supplied. This may be a fixed ratio or it may be a function of the level of manual input torque. In other words, the ratio may be smaller at low levels of manual input torque providing better "feel" and the ratio of motor torque supplied at high levels of input torque may provide the ability to provide increased force on the line.

The present invention may be embodied in other specific forms without departing from the spirit or essential attributes thereof and, accordingly, reference should be made to the appended claims, rather than to the foregoing specification as indicating the scope of the invention.

I claim:

1. A winch, comprising: a winch drum; a manual input drive for applying turning force to said winch drum; a motor for supplying turning force to said winch drum; and a controller for selectively controlling and varying the amount of torque supplied by said motor to said winch drum.

2. A winch in accordance with claim 1 wherein said motor is a servo motor.

3. A winch in accordance with claim 2 wherein said controller includes a servo motor controller and a winch controller.

4. A winch in accordance with claim 3 wherein said servo motor controller receives speed and direction signals from an encoder on said servo motor and supplies a digital signal to said winch controller, said winch controller providing a motor turning force command to said servo motor controller, which in turn controls said motor.

5. A winch in accordance with claim 4 wherein said winch controller receives a signal representing input torque which provides a signal to said winch controller indicative of the turning force of the manual input.

6. A winch in accordance with claim 5 wherein said signal representing input torque is generated by a torque sensor.

7. A winch in accordance with claim 1 wherein said motor is an electric motor.

8. A winch in accordance with claim 7 wherein said motor is an AC servo motor.

9. A winch in accordance with claim 7 wherein said motor is a DC motor.

10. A winch in accordance with claim 1 wherein said motor is a hydraulic motor.

11. A winch in accordance with claim 1 wherein said controller selectively controls the amount of turning force supplied by said motor to said winch drum by supplying a predetermined ratio of motor turning force to turning force supplied by said manual input drive.

12. A winch comprising: a winch drum: a manual input drive for applying turning force to said winch drum: a motor for supplying turning force to said winch drum: and a controller for selectively controlling the amount of torque supplied by said motor to said winch drum, wherein said controller for selectively controlling the amount of turning force supplied by said motor supplies a signal requiring a varying ratio of turning force which varies in a predetermined manner depending upon the amount of turning force applied via said manual input drive.

13. A method of driving a winch drum comprising the steps of:

detecting the amount of turning force or torque supplied by a manual input drive to said winch drum; supplying turning force or torque from a motor to said winch drum; and controlling the amount of turning force or torque supplied by said motor to said winch drum as a function of the amount of turning force or torque supplied by said manual drive.

14. A method in accordance with claim 13 wherein said function is a fixed predetermined ratio.

15. A method in accordance with claim 13 wherein said function is a ratio which varies depending upon the level of turning force or torque supplied by the manual input drive.

16. A power-assisted manual winch assembly comprising a winch drum; a manually actuated drive assembly for applying turning force to the winch drum; a motor and drive for applying supplemental turning force to the winch drum; a torque sensor associated with the drive assembly for determining the amount of turning force manually applied to the winch drum; and a controller electrically linked to the torque sensor and motor, for controlling the amount of supplemental turning force applied to the winch drum.

17. The winch assembly of claim 16 which further comprises a switch, clutch, or other means for disconnecting the motor, to provide a manual operation mode with no turning force assistance from the motor.

18. The winch assembly of claim 16 which further comprises one or more switches, actuation of which causes the winch to run at a selected predetermined speed without the manual application of turning force.

19. The winch assembly of claim 16 which further comprises one or more switches, actuation of which causes the winch to run at a selected predetermined torque without the manual application of turning force.

20. The winch assembly of claim 16 which further comprises a control, the position of which or the amount of pressure upon which determines the speed at which the winch will run, without the manual application of turning force.

21. The winch assembly of claim 16 which further comprises a control, the position of which or the amount of pressure upon which determines the torque applied by the winch, without the manual application of turning force.

* * * * *